US010561256B2

(12) United States Patent
Allen

(10) Patent No.: US 10,561,256 B2
(45) Date of Patent: Feb. 18, 2020

(54) LOCKER WITH ILLUMINATED INDICIA

(71) Applicant: Sam Allen, Maypearl, TX (US)

(72) Inventor: Sam Allen, Maypearl, TX (US)

( * ) Notice: Subject to any disclaimer, the term of this patent is extended or adjusted under 35 U.S.C. 154(b) by 0 days.

(21) Appl. No.: 15/639,117

(22) Filed: Jun. 30, 2017

(65) Prior Publication Data

US 2017/0295960 A1 Oct. 19, 2017

(51) Int. Cl.

| | |
|---|---|
| ***A47F 11/10*** | (2006.01) |
| ***B44C 5/08*** | (2006.01) |
| ***B44C 5/04*** | (2006.01) |
| ***F21V 33/00*** | (2006.01) |
| ***A47B 95/04*** | (2006.01) |
| *A47B 67/00* | (2006.01) |
| *A47B 96/20* | (2006.01) |
| *A47F 5/00* | (2006.01) |

(52) U.S. Cl.

CPC ..... *A47F 11/10* (2013.01); *A47B 95/04* (2013.01); *B44C 5/04* (2013.01); *B44C 5/0446* (2013.01); *B44C 5/08* (2013.01); *F21V 33/00* (2013.01); *A47B 67/005* (2013.01); *A47B 96/20* (2013.01); *A47B 2220/0077* (2013.01); *A47F 2005/0075* (2013.01)

(58) Field of Classification Search

CPC . A47B 95/04; A47F 11/10; B44C 5/04; B44C 5/0446; B44C 5/08; F21V 33/00

USPC ..... 312/257.1, 109, 138.1, 223.5; 40/541, 40/564, 568, 574, 575, 606.08; 362/133

See application file for complete search history.

(56) References Cited

U.S. PATENT DOCUMENTS

| | | | | |
|---|---|---|---|---|
| 3,707,792 | A * | 1/1973 | Mabrey | G09F 13/0409 40/219 |
| 6,526,681 | B1 * | 3/2003 | De Saro | G09F 13/04 40/564 |
| 8,910,402 | B2 * | 12/2014 | Mischel, Jr. | G09F 9/00 312/227 |
| 2004/0017137 | A1 * | 1/2004 | Straub | A47B 97/02 312/283 |
| 2005/0193606 | A1 * | 9/2005 | Stangl | A47B 13/12 40/606.08 |
| 2006/0248761 | A1 * | 11/2006 | Cheung | G09F 13/04 40/564 |
| 2007/0070615 | A1 * | 3/2007 | Joslin | G07F 11/72 362/92 |
| 2008/0252189 | A1 * | 10/2008 | Regan | A47B 81/00 312/249.8 |
| 2011/0277360 | A1 * | 11/2011 | Osiecki | B60R 13/005 40/541 |
| 2012/0011754 | A1 * | 1/2012 | Matyear | B32B 7/14 40/541 |
| 2014/0078407 | A1 * | 3/2014 | Green | G09F 9/35 348/836 |

(Continued)

*Primary Examiner* — James O Hansen
(74) *Attorney, Agent, or Firm* — James E. Walton

(57) ABSTRACT

A locker assembly having a backlit indicia includes a pair of sidewalls and a horizontal top defining a locker enclosure. At least one shelf extends at least partially between the sidewalls and defines a storage space in the locker enclosure. An illuminated panel extending at least partially between the sidewalls includes: an at least partially translucent sheet, a plurality of powered lighting elements disposed under the sheet, and a lighting enclosure cooperating with the panel to enclose the lighting elements.

8 Claims, 3 Drawing Sheets

(56) References Cited

U.S. PATENT DOCUMENTS

2015/0279251 A1* 10/2015 Matyear ..... H02S 40/38
362/183
2015/0371569 A1* 12/2015 Cole ..... G09F 13/12
40/219

* cited by examiner

LOCKER WITH ILLUMINATED INDICIA

BACKGROUND

1. Field of the Invention

The present invention relates generally to improvements in lockers or storage cabinets used in athletic or sporting facilities, and more specifically to illuminated panels incorporated into such lockers.

2. Description of Related Art

The aesthetics and utility of lockers or storage cabinets in "locker rooms" of athletic and sporting facilities of sports teams and country clubs, for example, have become a measure of the quality and prestige of such organizations and an increasingly important aspect of recruiting new team or club members. Modern lockers are a far cry from the simple wood or metal cabinets of the past.

Modern lockers incorporate storage for specific items of equipment, such as helmets and shoes, and features promoting comfort and luxury. There is a constant need for improvement in both functional and aesthetic aspects of such lockers.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
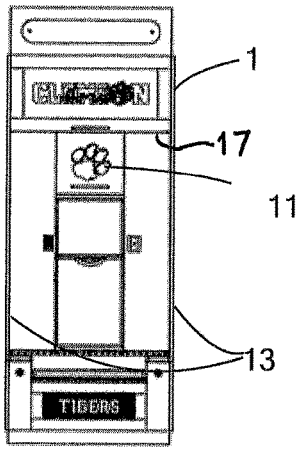
FIGS. 1 through 4 are elevation views of lockers incorporating the illuminated indicia panel according to the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the locker seat assembly are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Referring now to FIGS. 1 through 4 in the drawings, four configurations of lockers 1, 3, 5, 7, each incorporating a panel with illuminated indicia 11 according to the present application are illustrated. As can be seen, each locker 1, 3, 5, 7 comprises a pair of upstanding sidewalls 13 that generally define the extent of the locker. Each locker may be installed adjacent to another, similar or identical locker, with its rear against a wall, and its front facing the interior of the locker room.

Between the sidewalls 13 of each locker 1, 3, 5, 7, a plurality of compartments 15 are defined by shelves or other horizontally extending surfaces or platforms. Multiple additional sidewalls may be placed between the "main" or exterior sidewalls 13 to define compartments along with horizontal shelves 17 and the like. As used herein, "sidewall" or "sidewalls" may refer to either "main" sidewalls 13 or other sidewalls arranged between the "main" sidewalls. Each compartment 15 may be sized and otherwise configured for storage of clothing or sporting equipment or other items and may include one or more doors, which may be lockable.

Each of the lockers 1, 3, 5, 7 also incorporates a panel with illuminated indicia 11 (illuminated panel) according to an embodiment of the present application. In each example, the panel takes the form of a door giving access to a compartment behind the door, but the panel may be merely structural or cosmetic and have no other function. The indicia 11 may take the form of graphic art (the paw print and wildcat profile of FIGS. 1 and 2), lettering or logos comprised of stylized lettering (the UK of FIG. 3), or printed artwork on a single, monolithic illuminated panel as in the case of FIG. 4 (artwork is omitted for clarity).

Figure 2:
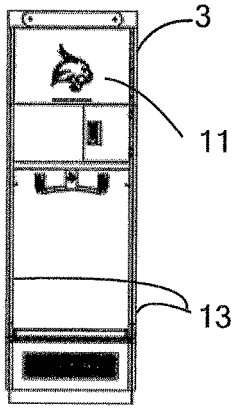
Figure 4:
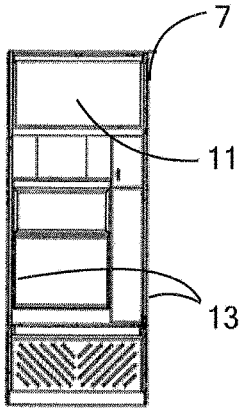
Figure 5:
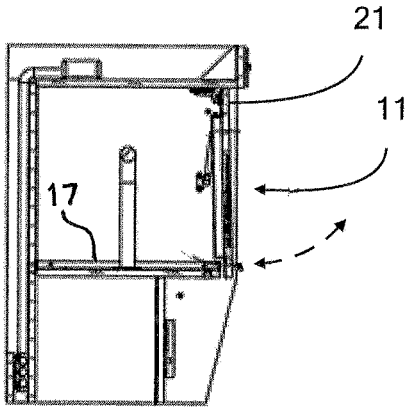
FIGS. 5 and 6 are enlarged, section views of the panel incorporating the illuminated indicia according to the present application.
Figure 6:
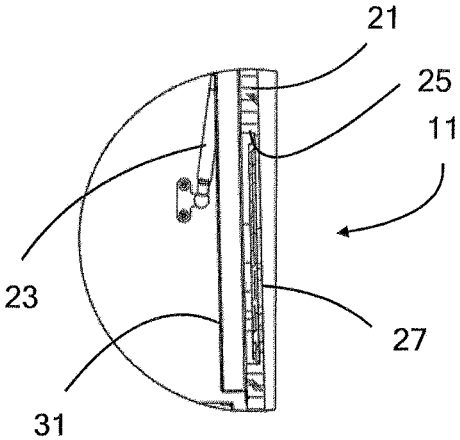

FIGS. 5 and 6 are enlarged section views of portions of locker 3 of FIG. 2, showing construction of the illuminated panel and indicia 11 according to the present application. In this embodiment, the panel comprises a door 21 formed of wood or wood-like material, such as particle board or oriented-strand board. In other embodiments (FIGS. 4 and 8, for example), door 21 may be formed mostly or entirely of translucent, light-transmitting material. Door 21 may be hinged at its upper extent to a horizontally extending surface of locker 3 so that it may be moved between open and closed positions. In other embodiments, door 21 may be hinged at the bottom or sides. An hydraulic or pneumatic hold-open strut 23 may be provided to assist in holding door 21 open and to prevent its slamming shut.

Figure 7:
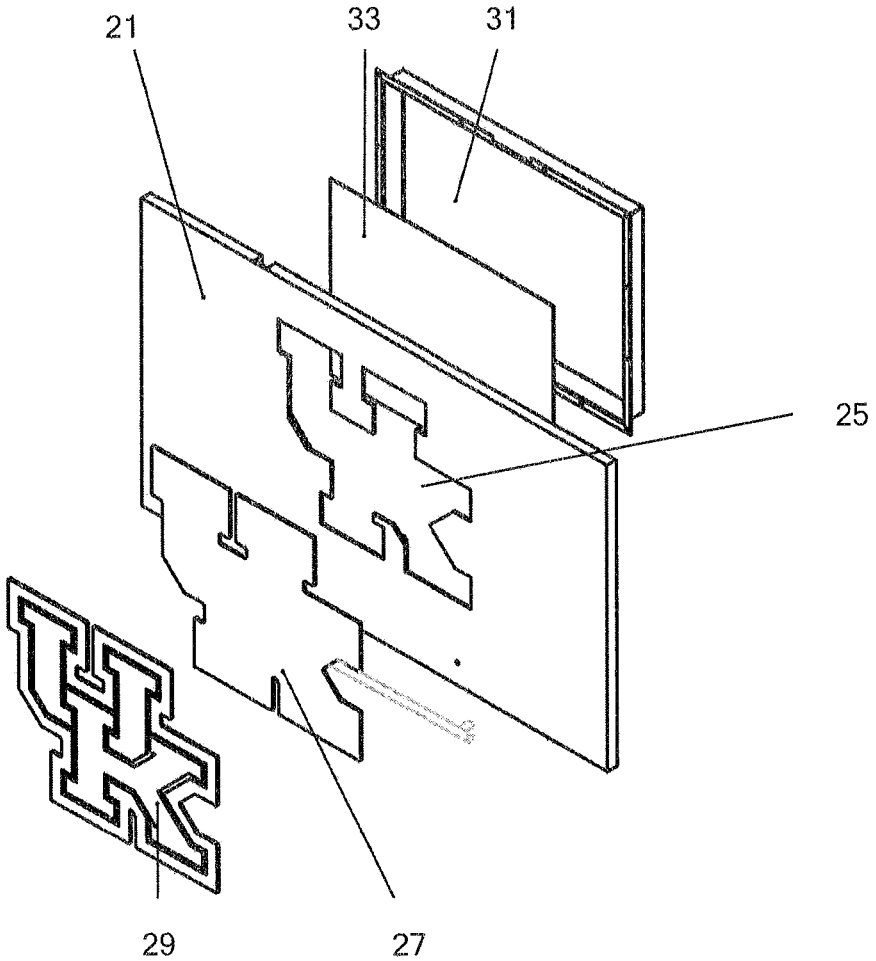
FIGS. 7 and 8 are enlarged, exploded views of illuminated panels according to the present application.

Referring also to FIG. 7, indicia 11 is formed in this embodiment by an aperture 25 that is cut to correspond to the outline of the graphic matter to be represented by the indicia, in this case the wildcat profile shown in FIG. 2. In other embodiments, the outline may be of lettering or a combination of graphic art and lettering or stylized lettering or the like. Secured within, and generally coextensive with, aperture or outline 25 may be one or more sheets 27, 29 of at least partially translucent, light-transmitting material, such as 0.125 inch thick acrylic, which is available in a variety of colors. Other polymeric or other light-transmitting or translucent materials may be appropriate.

For a single-color embodiment (as in the case of the paw of FIG. 1), only a single sheet of appropriately colored acrylic may be required and is dimensioned slightly larger than aperture or outline 25 to permit it to be secured to the reverse side of door 21 by adhesives or fasteners. In multi-colored embodiments, two or more sheets of differently colored acrylic adhered together may be necessary. For example, in the UK embodiment of FIG. 3, a first sheet of acrylic 29 comprising translucent lettering of a first color is cut coextensive with and in the same outline as aperture 25, but 0.25 inch smaller. The sheet 29 then is adhered to a second acrylic sheet 27 of a second color. Sheet 27 is dimensioned larger than aperture 25, and it should be understood that sheet 27 is secured to the reverse of door 21, sheet 29 thereby being supported within aperture 25. This produces an illuminated UK logo of letters formed by overlaying translucent sheets of the first and second color.

Secured to the rear of door 21 is a stainless-steel sheet-metal enclosure 31, which encloses and protects a light source 33 or at least one lighting element and its appropriate wiring for electric power. Lighting element 33 may be coupled either to a power supply contained elsewhere in or external to the locker or within enclosure 31. The power source may include dimmers, timers, switches and the like to turn off, dim, blink or otherwise manipulate the lighting emitting from source 33. Preferably, the lighting element is a panel array comprising a plurality white or colorless of light-emitting diodes (LEDs) molded or otherwise formed into a laminar sheet, as illustrated. Discrete LEDs, LED tubes, incandescent or fluorescent or other lighting elements may be appropriate. Colors other than white may be utilized, including combinations of colors. The LEDs or other lighting elements provides illumination for "back lighting" or transmitting light through the translucent portions or sheets secured to door or panel 21.

Figure 8:
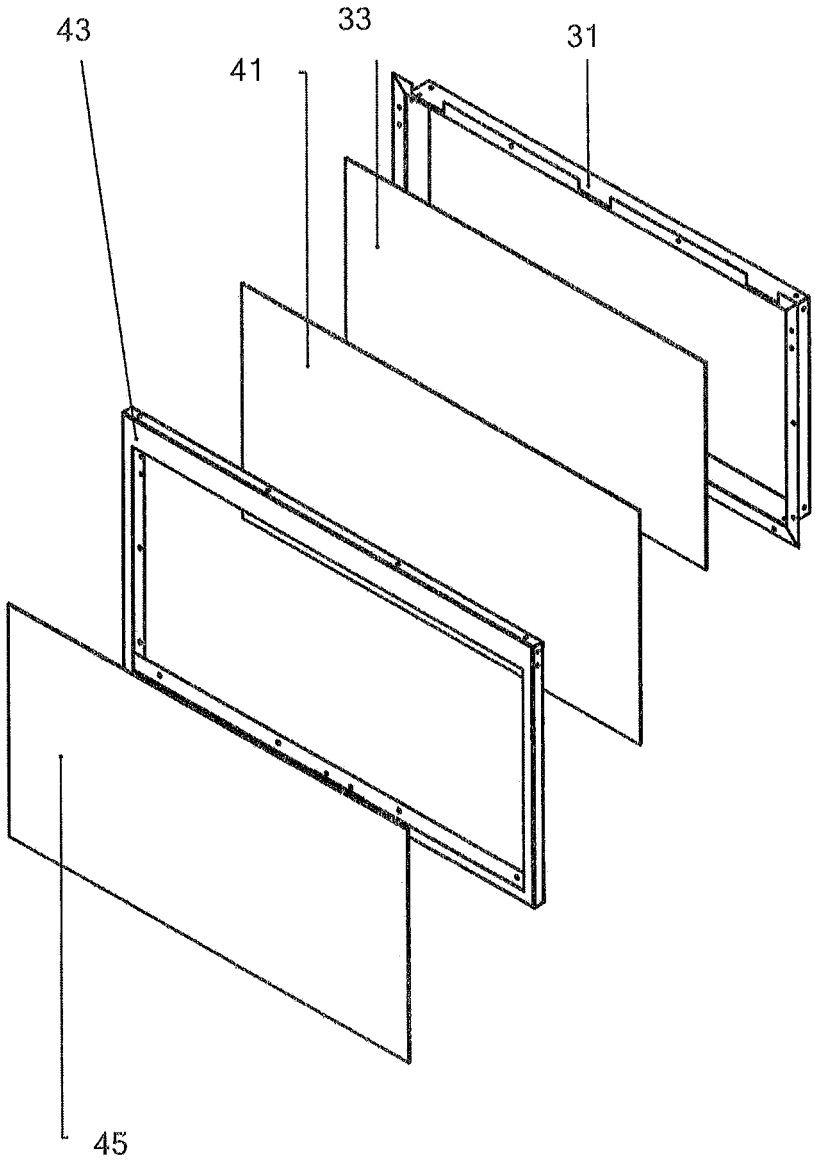

FIG. 8 illustrates construction of the single-layer monolithic panel embodiment shown in FIG. 4. In this embodiment, a single sheet of acrylic 41, preferably translucent or light-transmitting white, may be mounted within a steel perimeter frame 43 by adhesives or fasteners. This combination then forms the door or panel. The panel LED 33 light source and enclosure 31 are secured to frame 43 behind sheet 41. A removable graphics sheet 45 may be secured to the front of sheet 41 and is a translucent or transparent sheet (or may be opaque and contain graphic cut-outs or outlines) with printed or otherwise-applied graphics thereon. In a preferred embodiment, sheet 45 is magnetically secured to frame 43. This embodiment permits the graphics to be changed simply by removing and replacing graphics sheet 45.

Figure 3:
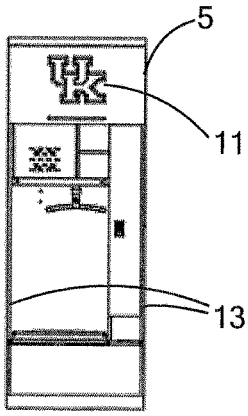

Graphics may also be implemented by combinations of the embodiments illustrated above, e.g. a translucent panel (FIG. 4) may be combined with a multi-layer graphic (FIGS. 2 and 3). The graphics may include an LED panel that is capable of displaying rudimentary or even full-motion or television-quality graphics. Such a panel may include the ability to display text banners and the like that are changeable via a programming module.

It is apparent that a system with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description and claims. Although the present embodiments are shown above, they are not limited to just these embodiments, but are amenable to various changes and modifications without departing from the spirit thereof.

I claim:

1. A locker assembly having a backlit indicia, comprising:
- a pair of sidewalls and a horizontal top defining a locker enclosure;
- at least one shelf extending at least partially between the sidewalls and defining a storage space in the locker enclosure; and
- an illuminated panel extending at least partially between the sidewalls, the illuminated panel being oriented in a generally upright position, the illuminated panel including:
  - an at least partially translucent sheet;
  - at least one powered lighting element disposed behind the sheet; and
  - a lighting enclosure cooperating with the panel to enclose the lighting element, the lighting enclosure being secured to the illuminated panel behind the lighting element;
- wherein the lighting enclosure and the lighting element together cover a rear face of the translucent sheet.

2. The locker assembly of claim 1, wherein the translucent sheet comprises:
- a first sheet of a selected color; and
- a second sheet of a selected color different than that of the first sheet;
- wherein the first and second sheets are overlaid to at least partially define a graphic design.

3. The locker assembly of claim 1, wherein the panel further comprises:
- an opaque sheet defining the panel; and
- an aperture formed in the opaque sheet to define at least an outline of a graphic design;
- wherein the translucent sheet is disposed between the opaque sheet and the lighting elements and lighting enclosure, so that light is transmitted through the translucent sheet and the aperture.

4. The locker assembly of claim 1, wherein the lighting elements are LEDs.

5. The locker assembly of claim 1, wherein the panel is movable between open and closed positions, the open position permitting access to the storage space in the locker enclosure.

6. A locker assembly, comprising:
- a pair of sidewalls and a horizontal top defining a locker enclosure;
- at least one shelf extending at least partially between the sidewalls and defining a storage space in the locker enclosure;
- a panel extending at least partially between the sidewalls and movable between open and closed positions, the open position permitting access to the storage space in the locker enclosure, the panel being in a generally upright orientation when in the closed position;
- an aperture formed in the panel to define at least an outline of a graphic design;
- a translucent sheet secured to the panel and at least coextensive with the aperture;
- at least one powered lighting element disposed behind the translucent sheet; and
- a lighting enclosure cooperating with the panel to enclose the lighting element;
- wherein the lighting enclosure is secured to the panel behind the lighting element, such that the lighting enclosure, lighting element, and translucent sheet all move together with the panel;
- wherein the lighting enclosure and the lighting element together cover a rear face of the translucent sheet.

7. The locker assembly of claim 6, wherein the translucent sheet comprises:

a first sheet of a selected color; and a second sheet of a selected color different than that of the first sheet;

wherein the first and second sheets are overlaid to at least partially define a graphic design.

8. The locker assembly of claim 6, wherein the lighting elements are LEDs.

* * * * *